United States Patent [19]

Nicholson

[11] Patent Number: 4,739,987

[45] Date of Patent: Apr. 26, 1988

[54] RESPIRATORY EXERCISER

[76] Inventor: Marguerite K. Nicholson, P.O. Box 14082, Orlando, Fla. 32857

[21] Appl. No.: 792,136

[22] Filed: Oct. 28, 1985

[51] Int. Cl.[4] ..... A63B 23/00
[52] U.S. Cl. ..... 272/99; 128/207.16
[58] Field of Search ..... 272/94; 128/725, 207.16

[56] References Cited

U.S. PATENT DOCUMENTS

| | | | |
|---|---|---|---|
| 3,635,214 | 1/1972 | Rand et al. | 272/99 |
| 3,710,780 | 1/1973 | Milch | 272/99 X |
| 3,977,395 | 8/1976 | Brawn | 272/99 |
| 4,025,070 | 5/1977 | McGill et al. | 272/99 |
| 4,221,381 | 9/1980 | Ericson | 272/99 |
| 4,533,137 | 8/1985 | Sonne | 272/99 |
| 4,601,465 | 7/1986 | Roy | 272/99 |

FOREIGN PATENT DOCUMENTS

| | | | |
|---|---|---|---|
| 210517 | 6/1909 | Fed. Rep. of Germany | 272/99 |

*Primary Examiner*—Richard J. Apley
*Assistant Examiner*—S. R. Crow
*Attorney, Agent, or Firm*—James H. Beusse

[57] ABSTRACT

A respiratory exerciser having a hollow body with three openings. One opening provides access for the user to breathe through the device. The other two openings regulate the inhalation and exhalation resistance, by the use of an aperture in each of two partitions which cover the openings to be brought into and out of alignment with an appropriate orifice in each of two rotatable caps, one cap for each partition. Independent inhalation and exhalation is acheived by the use of a diaphragm which acts as a one way check valve to prevent inhaling air from passing through the hole but allows exhaling air to pass through the hole.

10 Claims, 1 Drawing Sheet

RESPIRATORY EXERCISER

BACKGROUND OF THE INVENTION

This invention relates to respiratory exercise devices and, more particularly, to breathing exercise devices which promote proper inhalation and exhalation resistance by the user.

Respiratory exercisers, in general, are designed for purposes including the assistance of patients with lung problems due to chronic obstructive pulmonary disease (COPD) or postoperative loss of spontaneous deep breaths. The types of devices vary—one type may provide inhalation resistance while a second type may provide exhalation resistance. The devices are designed so that resistance can be varied to adjust for the changing strength or weakness of the user.

Until now, the devices have proven expensive to manufacture, awkward to use, large and bulky, difficult to clean and disinfect, or incapable of independently varying exhalation resistance from inhalation resistance. A so-called portable respiratory exerciser which provides both inhalation and exhalation resistance is described in U.S. Pat. No. 4,221,381. In the device according to that patent, a single adjustment is provided to vary a common opening which controls both inhalation and exhalation resistance.

It is desirable that a respiratory exerciser be designed with the ability to vary exhalation resistance independently from inhalation resistance. If the device is incapable of independent regulation, a user will adjust the respiratory exerciser to his particular weakness. For example, if the user's exhalation ability is greater than the user's inhalation ability, the device will be adjusted to strengthen inhalation and the user's exhalation strength will not increase.

It is an object of the present invention to provide a respiratory exerciser which is capable of varying exhalation resistance independently from inhalation resistance.

It is another object of the present invention to provide a respiratory exerciser which is inexpensive to manufacture.

It is another object of the present invention to provide a respiratory exerciser which is small and portable.

It is still another object of the present invention to provide a respiratory exerciser which is easy to clean and disinfect.

SUMMARY OF THE INVENTION

The improved respiratory exerciser of the present invention is characterized in that it is a small portable device in which exhalation resistance can be varied independently from inhalation resistance. One embodiment comprises a rigid hollow body with an opening for the user to breathe, a second opening to provide control of inhalation resistance, and a third opening to provide control of exhalation resistance. The second opening includes a partition, having an off-center aperture of predetermined diameter. Adjustability of inhalation resistance is achieved by the use of a cover which fits over the partition. The cover has a plurality of different size holes which can each be selectively positioned into and out of alignment with the aperture in the partition. Thus, when the user breathes through the first opening air will only pass through the second opening by way of the particular hole in the cover which aligns with the aperture in the partition. Resistance can be increased by aligning a smaller hole in the cover with the aperture in the partition and can be decreased by aligning a larger hole in the cover with the aperture in the partition.

The configuration of the third opening is similar to that of the second opening in that a cover with a plurality of various size holes fits over a partition blocking the third opening in such a way that the holes can each be positioned into and out of alignment with a small aperture in the partition. A flexible diaphragm is attached to the cover so as to overlay the holes in the cover. The diaphragm, in conjunction with the cover, acts as a one way check valve which permits the passage of exhaled air through the third opening, by way of the particular hole in the cover which aligns with the aperture in the partition, but prevents the passage of inhaled air. Thus, when the user breathes through the first opening inhaling air only passes through the second opening while exhaling air passes through both the second and third opening.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
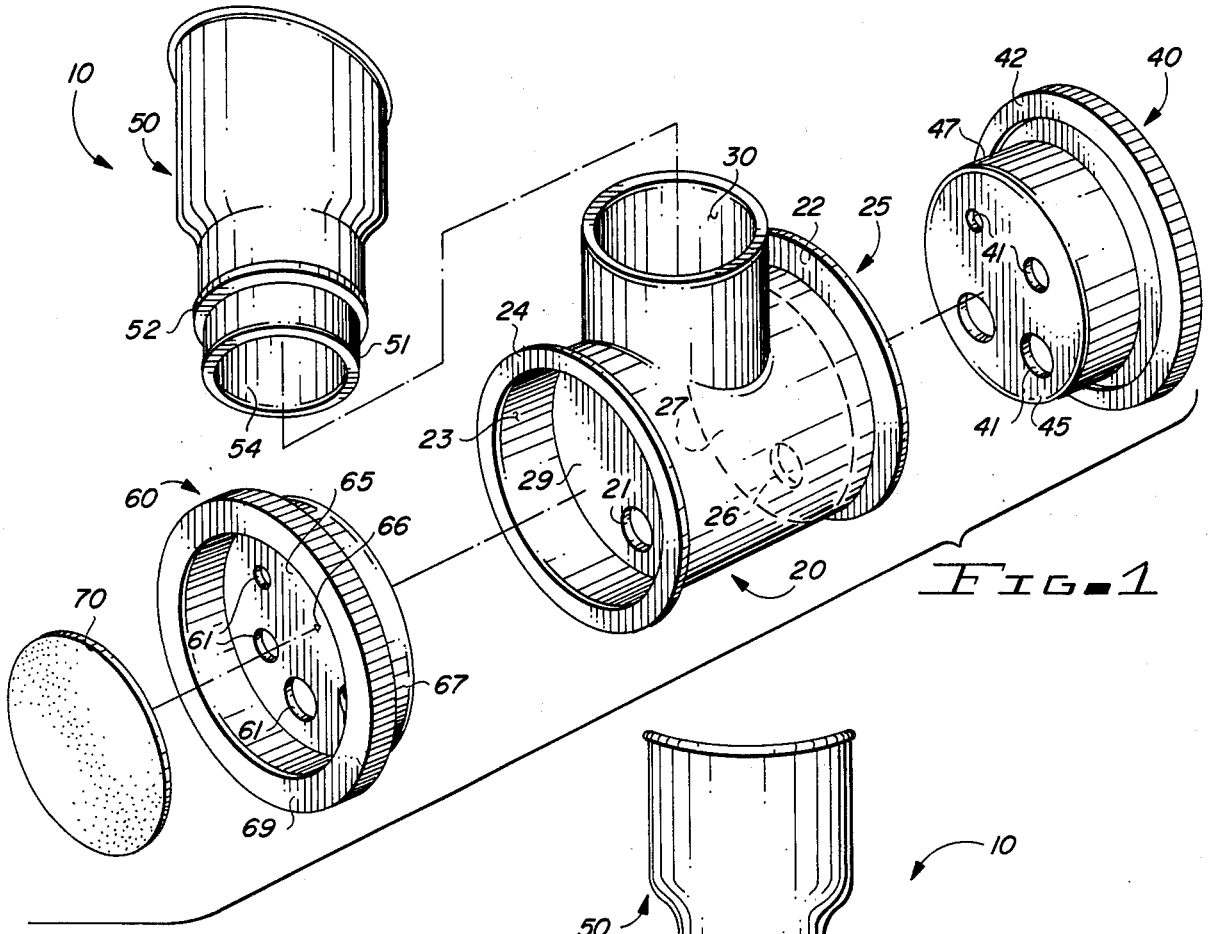
FIG. 1 is an exploded view of the respiratory exerciser of the present invention.
Figure 2:
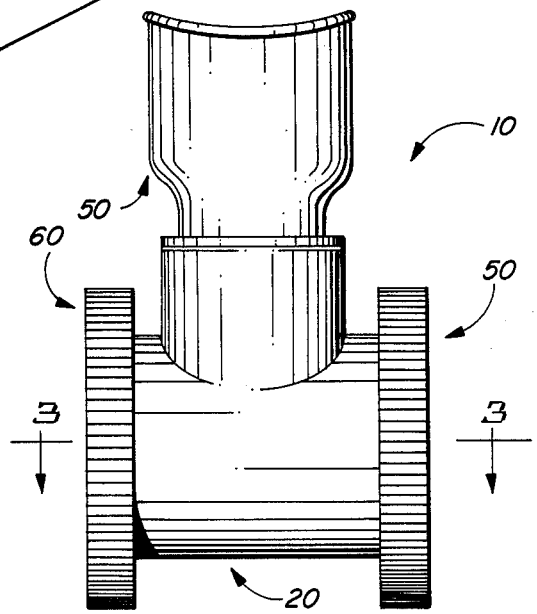
FIG. 2 is a side view of the respiratory exerciser of the present invention.

Referring to FIGS. 1 and 2, there is illustrated a preferred embodiment of a respiratory exerciser 10 in accordance with the present invention. Preferably the exerciser is constructed of a molded plastic. The respiratory exerciser 10 includes a T-shaped rigid hollow body 20 with three openings 23, 25 and 30 located at each end of the hollow body 20. Within opening 25 is a circular partition 27 which separates opening 25 from an inner cavity of body 20. An aperture 26 penetrates the partition 27 and is radially offset from the center of the partition 27. Along the edge of opening 25 is a peripheral rim 22. Similarly, opening 23 includes a circular partition 29 which separates opening 23 from the inner cavity of body 20, and an aperture 21, which penetrates the partition 29 and is radially offset from the center of the partition 29. Along the edge of opening 23 is a peripheral rim 24.

Figure 3:
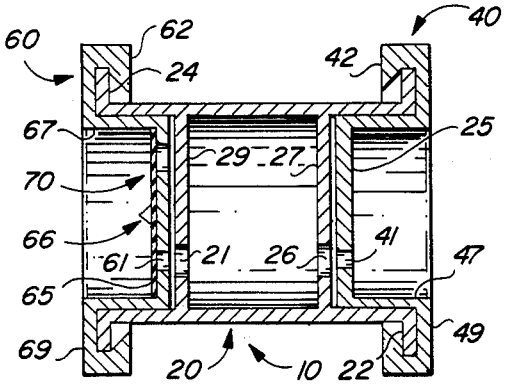
FIG. 3 is a cross-section 3—3 from FIG. 2.

An end cap 40, in the form of a shallow cup with a flat circular base 45, cylindrical sides 47, and a circular rim 49 which extends outwardly normal with respect to the cylindrical sides 47, mounts to the peripheral rim 22. The circular base 45 and the cylindrical sides 47 fit inside opening 25 with the circular base 45 fronting the partition 27. Reference is now made to FIG. 3, where it will be seen that the peripheral edge of the circular rim 49 terminates into an inwardly angled flange 42 which envelops the peripheral rim 22. Thus, when the end cap 40 is snapped onto the peripheral rim 22, the flange 42 restricts the motion of the end cap 40 to a planar rotation approximately parallel to the partition 27.

Reference is again made to FIG. 1, where it will be seen that a plurality of various size holes 41 penetrate the circular base 45 of the end cap 40. Each of the holes 41 in the circular base 45 is radially offset from the center of the circular base 45. The distance each of the holes 41 is radially offset from the center of cap 40 is equal to the distance the aperture 26 is radially offset from the center of partition 27. Thus, each of the holes 41 can be brought into and out of alignment with the aperture 26 in the partition 27. This has the effect of regulating the size of the aperture 26.

Referring to FIGS. 1 and 3 it will be seen that an end cap 60, in the form of a shallow cup with a flat circular base 65, cylindrical sides 67, and a circular rim 69 which extends outwardly normal with respect to the cylindrical sides 67, mounts to the peripheral rim 24. The circular base 65 and the cylindrical sides 67 fit inside opening 23 with the circular base 65 fronting the partition 29. The peripheral edge of the circular rim 69 terminates into an inwardly angled flange 62 which envelops the peripheral rim 24. Thus, when the end cap 60 is snapped onto the peripheral rim 24, the flange 62 restricts the motion of the end cap 60 to a planar rotation approximately parallel to the partition 29.

A plurality of various size holes 61 penetrate the circular base 65 of the end cap 60. Each of the holes 61 in the circular base 65 is radially offset from the center of the circular base 65. The distance each of the holes 61 is radially offset from the center of cap 60 is equal to the distance the aperture 21 is radially offset from the center of partition 29. Thus, each of the holes 61 can be brought into and out of alignment with the aperture 21 in the partition 29. This has the effect of regulating the size of aperture 21.

A diaphragm 70, preferably made from a thin sheet of flexible rubber, is attached to the outside face of circular base 65 which is otherwise open to atmosphere. The flexible diaphragm 70 is preferably attached to the circular base 65 by a two-pronged hook 66 molded to the outside face of circular base 65 and penetrating diaphragm 70.

Reference is now made to FIGS. 1 and 2, where it will be seen that a mouthpiece 50 is attached to the opening 30. The outside diameter of the base 51 of the mouthpiece 50 is slightly smaller than the inside diameter of the opening 30. Thus, the mouthpiece is frictionally mounted to the opening 30. An annular rib 52 is attached to the base 51 but away from the end 54 of the base 51. The rib 52 prevents the mouthpiece 50 from penetrating too deep within the inner cavity of the hollow body 20.

Figure 4:
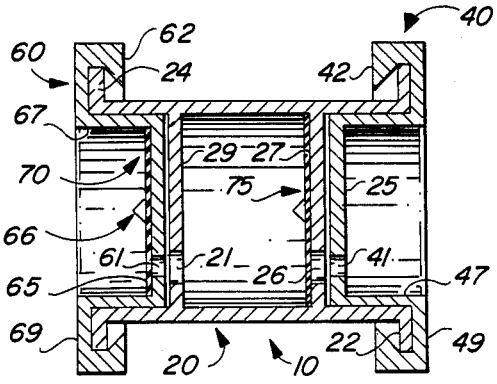
FIG. 4 is a cross-section 3—3 from FIG. 2 illustrating an alternate embodiment of the inventive respiratory exerciser including a second flexible diaphragm.

While the principals of the invention have now been made clear in an illustrative embodiment, there will become obvious to those skilled in the art many modifications in structure, arrangement, portions, materials and components used in the practice of the invention and otherwise which are particularly adapted for specific operating requirements without departing from those principals. For example in a first alternate embodiment illustrated in FIG. 4, a second flexible diaphragm 75 could be attached to the inner surface of the partition 27 and overlay the aperture 26 to prevent the passage of exhaled air through opening 25 and the body 10 could be formed in other than a T-shape. The appended claims are therefore intended to cover and embrace any such modifications, within the limits only of the true spirit and scope of the invention.

I claim:

1. A respiratory exerciser for creating inhalation resistance and exhalation resistance to strengthen respiratory muscles comprising:

(a) a substantially rigid hollow body having a first opening to provide access for breathing, a second opening and a third opening;

(b) means for regulating the size of the second opening comprising:

(i) a first rigid partition which blocks the second opening, said first rigid partition including a first aperture which is radially offset from the center of said first rigid partition; and (ii) a first rotatable cap in the form of a shallow cup, said first rotatable cap comprising a first flat circular base, a first cylindrical side wall which protrudes normal to said first circular base and a first circular rim which extends outwardly normal from said first cylindrical side wall, said first circular base including a plurality of various size holes penetrating said base, the holes being radially offset from the center of said circular base by a distance equal to the distance the first aperture is radially offset from the center of said first rigid partition, said first rotatable cap being rotatably connected to said hollow body so that the second opening is covered by said first rotatable cap and air passing through the second opening will pass through only one preselected hole in said first rotatable cap at any rotational position of said first rotatable cap;

(c) means for regulating the size of the third opening comprising:

(i) a second rigid partition blocking the third opening, said second rigid partition including a second aperture which is radially offset from the center of said second rigid partition; and (ii) a second rotatable cap including a second flat circular base, a second cylindrical side wall protruding normal to said second circular base, and a second circular rim extending outwardly normal from said cylindrical side wall, said second circular base including a plurality of various size holes penetrating said second circular base, the holes being radially offset from the center of said circular base by a distance equal to the distance the second aperture is radially offset from the center of said second rigid partition, said second rotatable cap being rotatably connected to said hollow body so that the third opening is covered by said second rotatable cap and air passing through the third opening will pass through only one preselected hole in said second rotatable cap at any rotational position of said second rotatable cap; and (d) means for preventing the passage of inhaling air through said third opening comprising a flexible diaphragm attached to an outer surface of said second cap.

2. A respiratory exerciser according to claim 1 wherein said rigid hollow body further comprises a first peripheral rim along the edge of the second opening and said first rotatable cap further comprises a first inwardly angled flange along the peripheral edge of said first circular rim which envelops said first peripheral rim.

3. A respiratory exerciser according to claim 2 wherein said rigid hollow body further comprises a second peripheral rim along the edge of said third opening and said second rotatable cap further comprises a second inwardly angled flange along the peripheral edge of said second circular rim which envelops said second peripheral rim.

4. A respiratory exerciser according to claim 1 wherein the first opening is a mouthpiece.

5. A respiratory exerciser according to claim 1 further comprising a mouthpiece assembly removably connected to the first opening.

6. A respiratory exerciser according to claim 1 further comprising a flexible diaphragm attached to the inner surface of said first rigid partition.

7. A respiratory exerciser for enhancing a users lung capacity comprising:

(a) a hollow body member having at least three openings, the first opening being adapted for breathing through by the user;

(b) first means connected to the second opening for controlling the size of the second opening comprising:

(i) a first rigid partition which blocks the second opening, said first rigid portion including a first aperture which is radially offset from the center of said first rigid partition; and (ii) a first rotatable cap in the form of a flat circular disc having a first pair of opposing circular end faces, said first rotatable cap including a plurality of faces, the holes being radially offset from the center of each of said first pair of end faces by a distance equal to the distance the first aperture is radially offset from the center of said first rigid partition, said first rotatable cap being rotatably connected to said hollow body member so that the second opening is covered by said first rotatable cap and air passing through the second opening will not pass through only one preselected hole in said first rotatable cap at any rotational position of said first rotatable cap;

(c) second means connected to the third opening for controlling the size of the third opening comprising:

(i) a second rigid partition which blocks the third opening, said second rigid partition including a second aperture which is radially offset from the center of said second rigid partition; and (ii) a second rotatable cap in the form of a flat circular disc having a second pair of opposing circular end faces, said second rotatable cap including a plurality of various size holes penetrating said second pair of opposing end faces, the holes being radially offset from the center of each of said second pair of end faces by a distance equal to the distance the second aperture is radially offset from the center of said second rigid partition, said second rotatable cap being rotatably connected to said hollow body member so that the third opening is covered by said second rotatable cap and air passing through the third opening will pass through only one preselected hole in said second rotatable cap at any rotational position of said second rotatable cap; and (d) means connected to said second connecting means for permitting air to pass in only a single direction through the third opening.

8. A respiratory exerciser according to claim 7 wherein said air permitting means comprises a flexible diaphragm attached to an outermost end face of said second rotatable cap which overlays the holes penetrating said second pair of end faces.

9. A respiratory exerciser according to claim 7 wherein said air permitting means comprises a flexible diaphragm attached to the inner surface of said second rigid partition which overlays the aperture penetrating said second partition.

10. A respiratory exerciser according to claim 8 further comprising a second flexible diaphragm attached to the inner surface of said first partition which overlays the aperture penetrating said first partition.

* * * * *